US009459010B2

(12) United States Patent
Asofsky et al.

(10) Patent No.: US 9,459,010 B2
(45) Date of Patent: Oct. 4, 2016

(54) FUNCTION INDICATOR SYSTEM FOR ELECTRIC FIREPLACE

(75) Inventors: Mark Asofsky, Delray Beach, FL (US); Tyler Nemes, Delray Beach, FL (US)

(73) Assignee: TWIN-STAR INTERNATIONAL, INC., Delray Beach, FL (US)

( * ) Notice: Subject to any disclaimer, the term of this patent is extended or adjusted under 35 U.S.C. 154(b) by 0 days.

(21) Appl. No.: 13/292,068

(22) Filed: Nov. 8, 2011

(65) Prior Publication Data

US 2012/0048841 A1 Mar. 1, 2012

Related U.S. Application Data

(63) Continuation-in-part of application No. 12/573,933, filed on Oct. 6, 2009.

(51) Int. Cl.

| | |
|---|---|
| ***G05B 23/02*** | (2006.01) |
| ***F24C 7/00*** | (2006.01) |
| ***F24C 7/08*** | (2006.01) |

(52) U.S. Cl.

CPC ..... *F24C 7/004* (2013.01); *F24C 7/081* (2013.01); *F24D 2200/10* (2013.01)

(58) Field of Classification Search

CPC ..... G09F 19/12; F24C 7/004
USPC ..... 340/3.1
See application file for complete search history.

(56) References Cited

U.S. PATENT DOCUMENTS

| | | | | |
|---|---|---|---|---|
| 5,724,261 | A * | 3/1998 | Denny et al. | 702/184 |
| 6,393,207 | B1 * | 5/2002 | Martin et al. | 392/348 |
| 6,919,884 | B2 * | 7/2005 | Mix et al. | 345/204 |
| 7,451,759 | B2 * | 11/2008 | Weiss et al. | 126/286 |
| 2004/0169588 | A1 * | 9/2004 | Imamura et al. | 340/644 |
| 2006/0099565 | A1 * | 5/2006 | Rosserot | 434/365 |
| 2006/0213097 | A1 * | 9/2006 | Haugom | 40/428 |
| 2009/0126241 | A1 | 5/2009 | Asofsky | |
| 2011/0080261 | A1 | 4/2011 | Asofsky et al. | |

FOREIGN PATENT DOCUMENTS

| | | |
|---|---|---|
| WO | 2009068518 | 6/2009 |

* cited by examiner

*Primary Examiner* — Vernal Brown
(74) *Attorney, Agent, or Firm* — Johnson & Martin, P.A.; James David Johnson

(57) ABSTRACT

A function indicator system and methods for indicating the control settings related to functions and features of an electric fireplace are described. The function indicator system can feature a function indicator module, a controller communicatively connected to the function indicator module, and a connected power source. The function indicator module can contain a plurality of light sources that emit paths of light, which can pass through control status indicia to create a visual display on an exterior surface of a projection screen of the electric fireplace. The visual display is visible to a viewer so as to alert the viewer as to the particular status of a control setting of the electric fireplace such as, for example, the temperature of heat produced, the brightness of simulated flames, or the power setting of a heater of the electric fireplace.

29 Claims, 13 Drawing Sheets

FUNCTION INDICATOR SYSTEM FOR ELECTRIC FIREPLACE

CROSS-REFERENCE TO RELATED APPLICATION

This application claims the priority from U.S. nonprovisional patent application Ser. No. 12/573,933 filed Oct. 6, 2009. The foregoing application is incorporated in its entirety herein by reference.

FIELD OF THE INVENTION

The invention relates to a feature and function status indicator system. More particularly, the invention relates to a system for indicating the control settings for various features and functions of an electric fireplace.

BACKGROUND

As a source of heat and for aesthetic reasons, fireplaces are frequently incorporated into homes. There are currently several fireplace options available to consumers: traditional fuel (wood or coal)-burning fireplaces, gas-burning fireplaces, and electric fireplaces. Traditional fuel-burning fireplaces generally offer the greatest heat-production and aesthetics, but require more set-up and maintenance time to operate. Gas-burning fireplaces offer a real flame and convenience, but lack the natural sound, flickering, and shadowing associated with traditional fuel-burning fires. Electric fireplaces do not offer a real flame, but have many safety and convenience features.

Traditional fuel-burning and gas-burning fireplaces as well as conventional electric fireplaces also lack a visually attractive display means for displaying control settings. For example, a conventional electric fireplace does not feature a lighted visual display by which a user can quickly and easily determine the currently selected control settings simply by looking at the electric fireplace.

Traditional fireplaces and current electric fireplaces also lack devices for signaling visually and audibly when a heater or heat source has been disabled so as to terminate its ability to generate heat. A need exists for this important safety feature.

SUMMARY

The invention relates to electric fireplaces having a function indicator system for producing a visual status display that alerts a user as to the status levels for one or more control settings features and functions of the electric fireplace. The function indicator system can feature an electric fireplace having a projection screen, a function indicator module, a controller, and a power source. The function indicator module can include a plurality of function indicator lights that emit a path of light, which passes through a control status indicia printed on a translucent film. Each of the printed control status indicia can be aligned with one or more function indicator lights so that the light emitted by the function indicator light or lights with which the indicia is aligned passes through the indicia to form a visual status display on an exterior surface of the electric fireplace's projection screen.

The electric fireplace can further include a heater and controls for the settings of the heater including its temperature and power. The heater controls and other controls of the system may be switches, buttons, or touchscreen controls.

The system can feature one or more devices for generating either or both of audible and visual signals to indicate to a user when power to the heater has been turned on or off.

One advantage of incorporating the function indicator system in the construction of an electric fireplace is that a user or other viewers can easily and quickly determine the status of various control settings. For example, the user can view the visual status display projected onto the projection screen to determine the exact high, intermediate, or low settings of several control settings such as power control, heater temperature, blower or fan speed, simulated flame intensity, burning wood soundtrack volume, light brightness or intensity, or timer control.

Another advantage of the function indicator system is that the visual status display provides a modern, aesthetically pleasing means for viewing and controlling the control status settings for an electric fireplace.

Another advantage of the systems and methods described herein is the ability of the system to signal either or both visibly and audibly to a user that a heater of the electric fireplace has been disabled.

Accordingly, the invention features a system for displaying the control settings for an electric fireplace. The system can include an electric fireplace having a projection screen, a function indicator module for creating a visual status display of the electric fireplace's control settings on the projection screen, a controller communicatively connected to the function indicator module, and a power source.

In another aspect, the invention can feature the function indicator module including at least one function indicator light.

In another aspect, the invention can feature the electric fireplace further including a heater. The heater can include a heater air outlet covered by a grill or mesh.

In another aspect, the invention can feature the function indicator module being installed inside the electric fireplace behind the grill or mesh of the heater air outlet.

In another aspect, the invention can feature the system including a heater power control feature to turn on and off the power to the heater. The heater power control feature can be a button or touchscreen control that is depressible for a predetermined period of time to power the heater on and off.

In another aspect, the invention can feature a heater power control feature to turn on and off the power to the heater and a separate heater disabling feature capable of being operated to enable or disable the heater, wherein the heater disabling feature is a concealed feature of a control feature of the electric fireplace other than the heater power control feature.

In another aspect, the invention can feature the system further including at least one first device for generating a first signal that is perceivable visually or audibly by a user, wherein the first signal indicates to the user that power to the heater has been turned on so that heat will be generated, and at least one second device for generating a second signal that is perceivable visually or audibly by a user, wherein the second signal indicates to the user that power to the heater has been turned off so that heat will not be generated.

In another aspect, the invention can feature the first signal including an audible tone or sound, a visible flash or pulse of light, an icon or text comprised of light visibly projected onto a projection screen of the electric fireplace, or a combination of one or more of these signals, and the second signal including an audible tone or sound, a visible flash or pulse of light, an icon or text comprised of light visibly projected onto a projection screen of the electric fireplace, or a combination of one or more of these signals.

In another aspect, the invention can feature a visual status display created by the function indicator module that is visible on an exterior surface of the projection screen as a projected icon or text.

In another aspect, the invention can feature the projected icon or text being the visual status display for at least one of the following settings: system power, heater power, temperature, light brightness, blower or fan speed, timer, flame control, and speaker volume.

In another aspect, the invention can feature the system further including a dimmer that is communicatively connected to the function indicator module.

In another aspect, the invention can feature the dimmer being programmed to vary the brightness and intensity of light emitted by the at least one function indicator light.

In another aspect, the invention can feature at least one function indicator light sequencing through a range of light intensity from no light to the brightest light setting so that the light of a visual status display, which visual status display features light emitted by the at least one function indicator light of the function indicator module that is projected so as to be visible on an exterior surface of the projection screen, fades away partially or entirely after a predetermined period of time.

In another aspect, the invention can feature the electric fireplace including a frame comprising a front portion.

In another aspect, the invention can feature the function indicator system being installed inside the electric fireplace behind an interior surface of the front portion of the frame.

In another aspect, the invention can feature the electric fireplace further including a control panel installed on a front portion of a frame of the electric fireplace, wherein the control panel comprises a housing.

In another aspect, the invention can feature the function indicator module being installed inside the control panel.

In another aspect, the invention can feature the function indicator module including touchscreen controls.

A method of the invention can be used to indicate a power setting of a heater of an electric fireplace. The method can include the steps of: (a) turning on power to a heater of an electric fireplace so that the heater is enabled to generate heat; (b) providing a first signal that is perceivable visually or audibly by a user, wherein the first signal indicates to the user that power to the heater has been turned on so that heat will be generated; (c) turning off power to the heater so that the heater is disabled from generating heat; and (d) providing a second signal that is perceivable visually or audibly by a user, wherein the second signal indicates to the user that power to the heater has been turned off so that heat will not be generated.

Another method of the invention can feature the first signal being an audible tone or sound, a visible flash or pulse of light, an icon or text comprised of light visibly projected onto a projection screen of the electric fireplace, or a combination of one or more of these signals, and the second signal being an audible tone or sound, a visible flash or pulse of light, an icon or text comprised of light visibly projected onto a projection screen of the electric fireplace, or a combination of one or more of these signals.

Another method of the invention can be used to disable a heater of an electric fireplace by turning off power to the heater. The method can include the steps of: (a) providing an electric fireplace featuring a heater, a heater power control feature, and a heater disabling feature; (b) using the heater disabling feature, disabling the heater so that power to the heater cannot be turned on using the heater power control feature of the electric fireplace; and (c) providing a signal that is perceivable visually or audibly by a user, wherein the signal indicates to the user that power to the heater has been disabled so that the heater cannot be powered on.

Another method of the invention can feature step (b) of the method further including manually pressing the heater power control feature.

Another method of the invention can feature step (b) of the method further including turning off power to the heater after a predetermined period of time in response to instructions received from a controller communicatively connected to the heater disabling feature.

Another method of the invention can feature the heater disabling feature being operated using a different control feature of the electric fireplace so as to be a concealed feature of the different control feature.

Another method of the invention can feature the signal being an audible tone or sound, a visible flash or pulse of light, a flash of light in an ember bed of the electric fireplace, a flash of light of simulated flames of the electric fireplace, an icon or text comprised of light visibly projected onto a projection screen of the electric fireplace, an icon or text comprised of light visible on a control panel or frame of the electric fireplace, or a combination of one or more of these signals.

Unless otherwise defined, all technical terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents and other references mentioned herein are incorporated by reference in their entirety. In the case of conflict, the present specification, including definitions will control.

DETAILED DESCRIPTION

Figure 1:
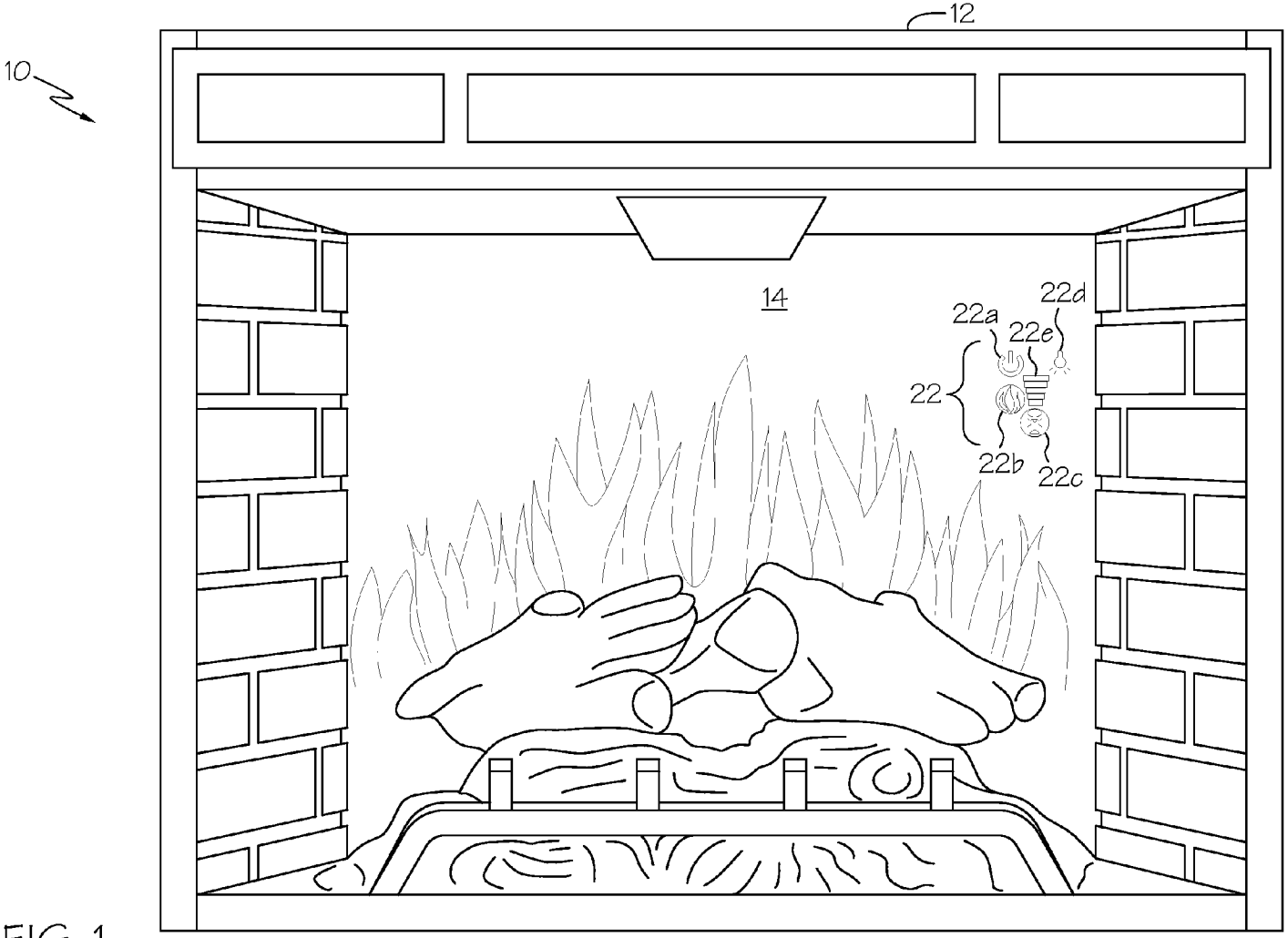
FIG. 1 is a front view of an electric fireplace having a function indicator system.

The invention provides systems for displaying the control settings for an electric fireplace, which govern the features and functions of the electric fireplace. In an exemplary embodiment, the system 10 can include an electric fireplace 12 featuring a projection screen 14, a function indicator module 16, a controller 18, and a power source 20. The electric fireplace 12 can include light systems that produce simulated flame effects and simulated ember bed light effects. The simulated flame effects can be projected onto the projection screen behind, above, onto, or around a simulated fuel source, e.g., a logset, that may be constructed from natural or artificial materials. The simulated ember bed light effects can be projected can be projected under, within, above, onto, or around a simulated fuel bed, e.g., an ember bed, that may be constructed from natural or artificial materials. The electric fireplace 12 can also feature one or more speakers or other sound generation devices that store and play or produce sound effects such as, for example, auditory signals (e.g., power on/off tone) or soundtracks featuring the sounds of burning wood, popping embers, or other sounds related to flames and burning fuel materials.

Figure 5:
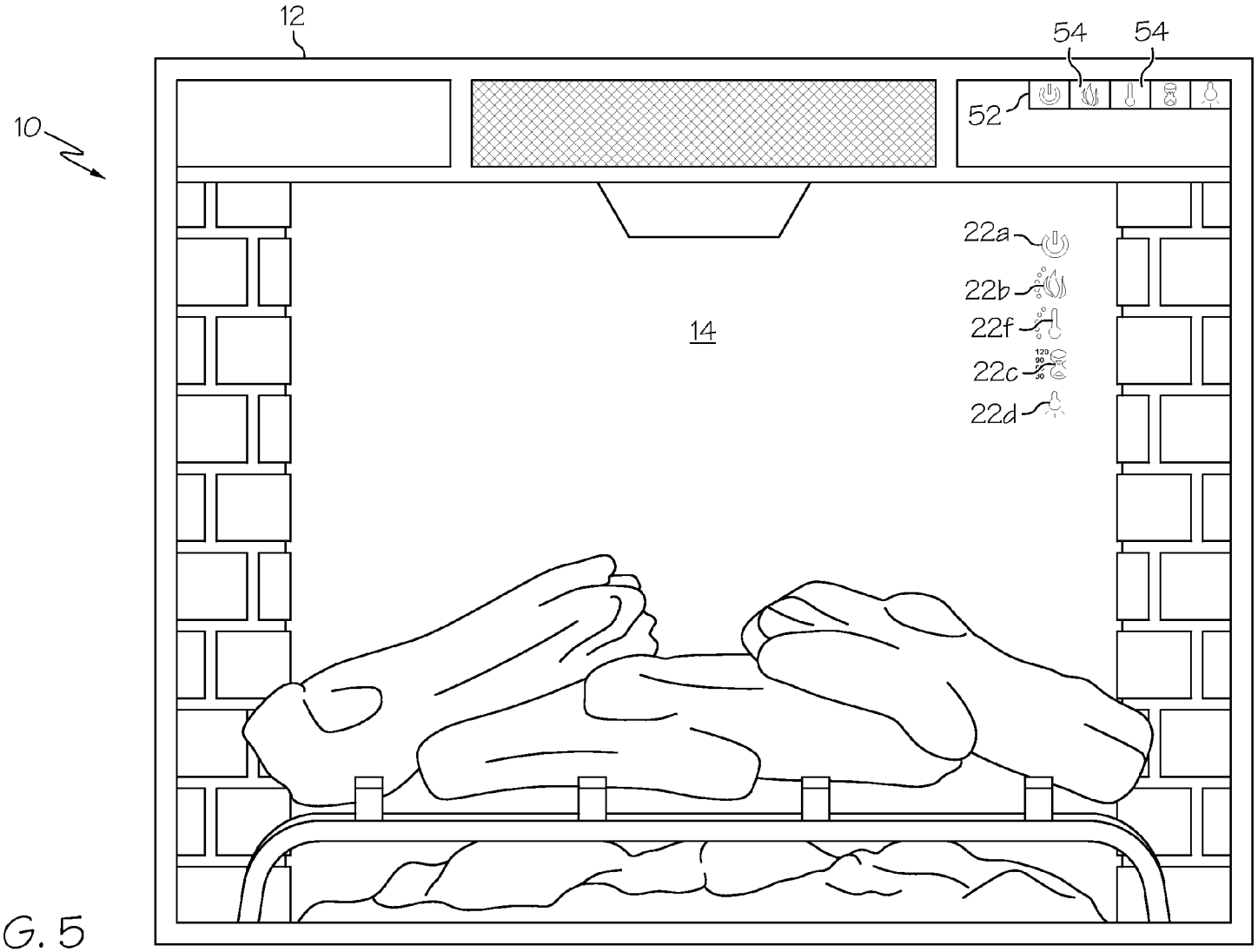
FIG. 5 is a front view of the electric fireplace of FIG. 4 with a visual display of control settings projected onto the projection screen so as to be visible on an exterior surface of the projection screen.

FIG. 1 shows an electric fireplace 12 with control setting status visibly displayed in a visual status display 22 on the projection screen 14 for (starting at top left and moving counterclockwise) power (on/off) control 22*a*, simulated flame intensity control 22*b*, timer control 22*c*, and light brightness or intensity control 22*d*. A status bar or level status indicator 22*e* is pictured in the center of the visual status display 22. The visual status display 22 can also include a temperature control 22*f* as shown in FIG. 5.

Figure 2:
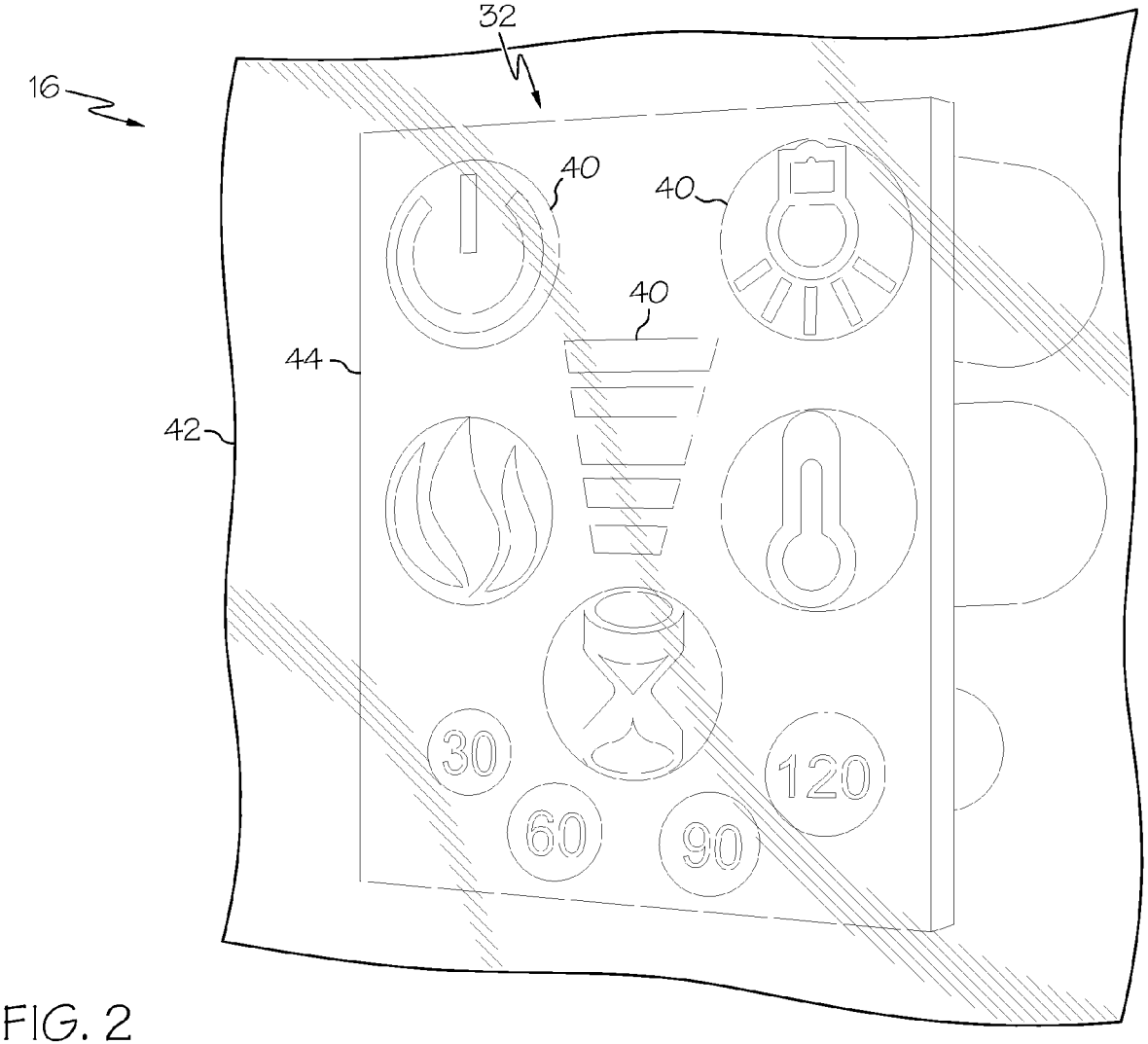
FIG. 2 is a front perspective view of a function indicator module of the function indicator system of FIG. 1.
Figure 3:
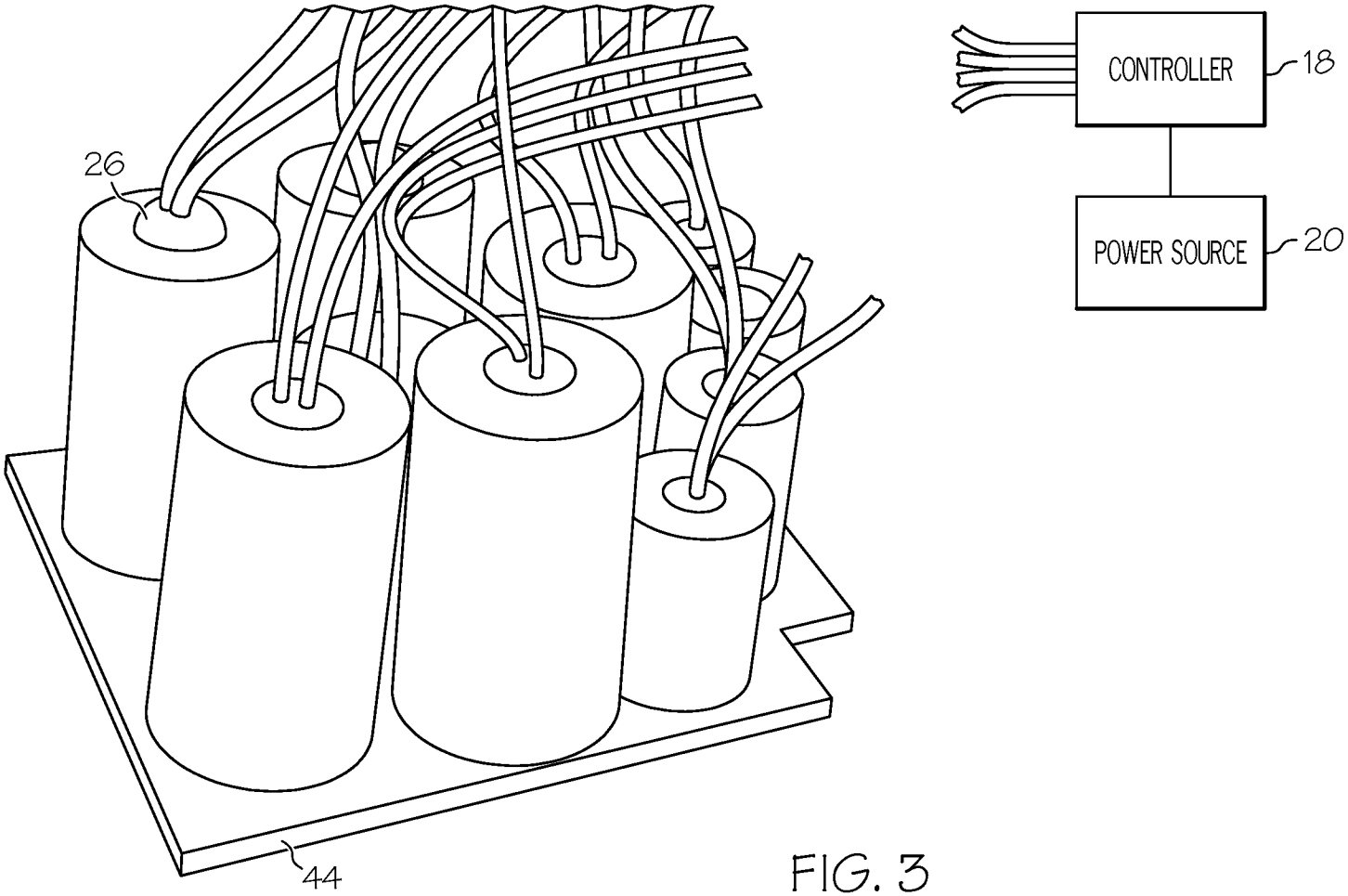
FIG. 3 is a rear perspective view of the function indicator module of FIG. 2.
Figure 8:
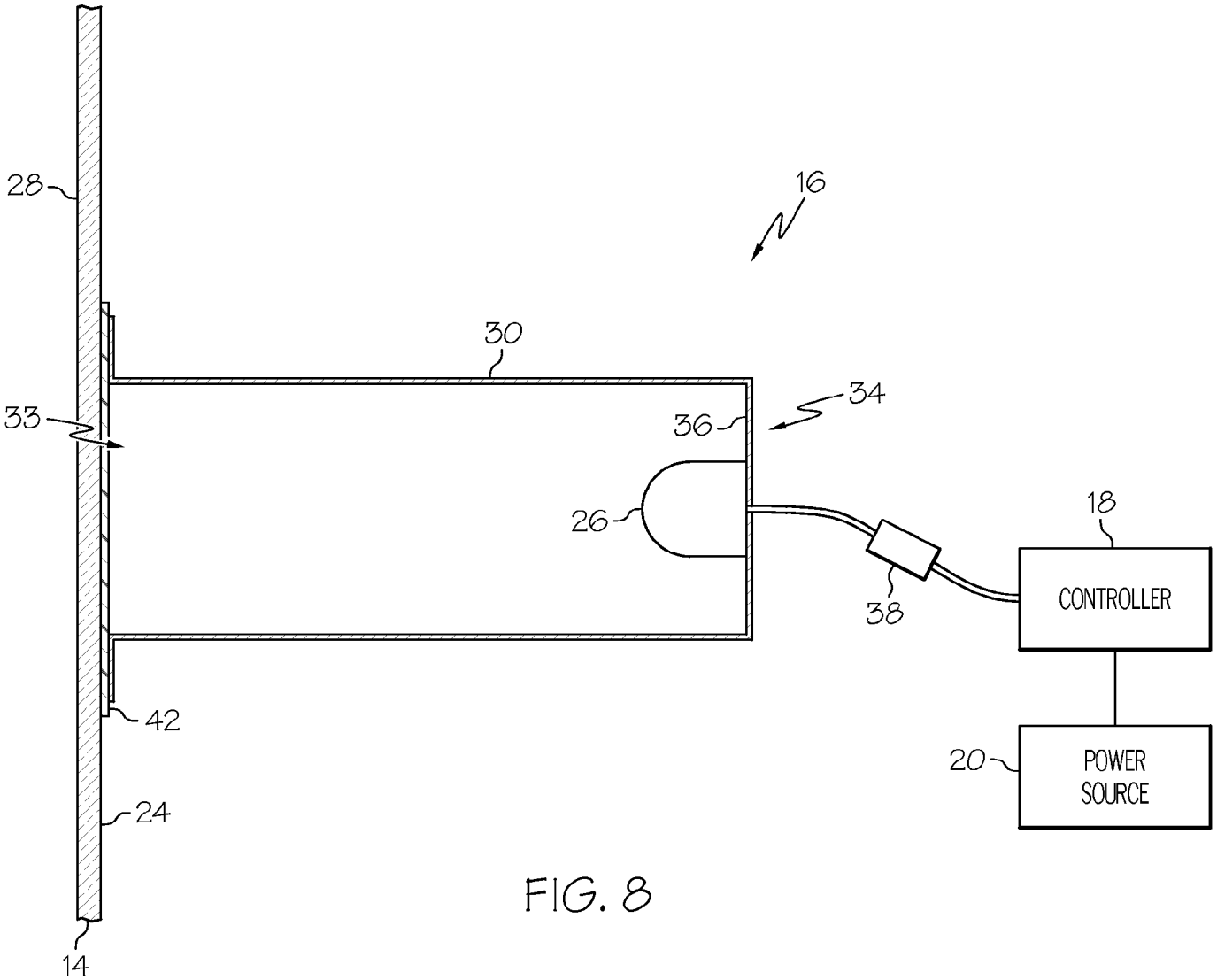
FIG. 8 is a cut-away side view of an electric fireplace and function indicator system.
Figure 14A:
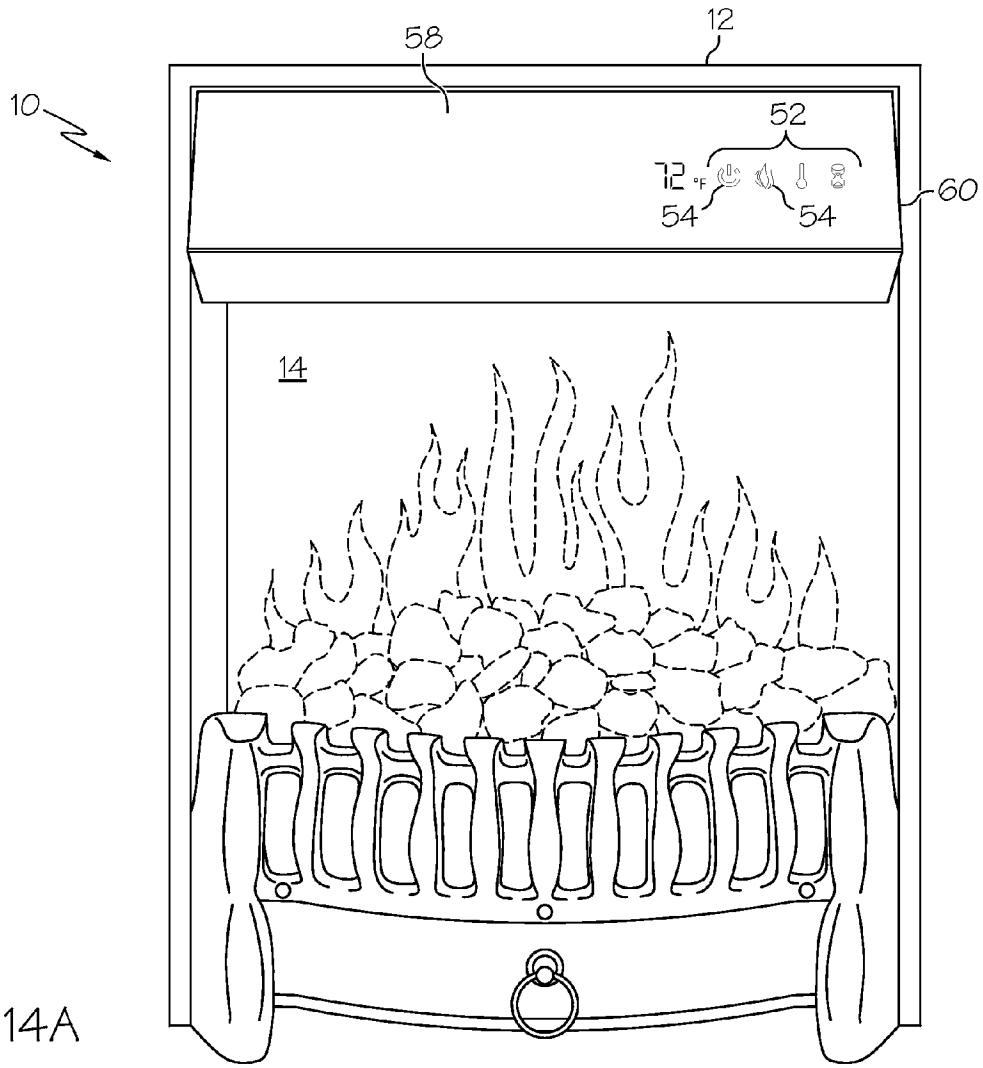
FIG. 14A is a front perspective view of another embodiment of an electric fireplace featuring control buttons.
Figure 14B:
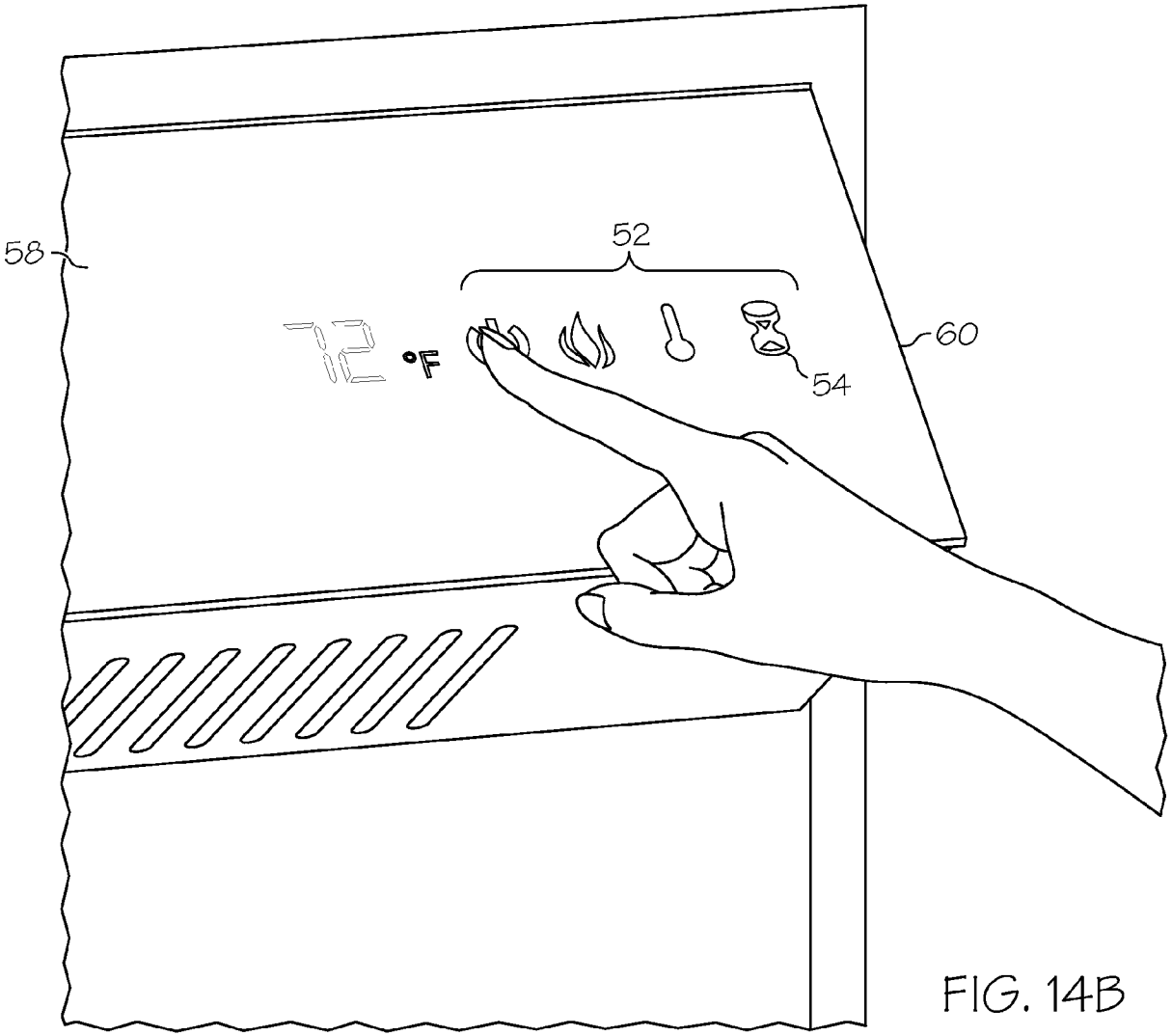
FIG. 14B is a close-up view partial perspective view of the control buttons of the electric fireplace of FIG. 14A being operated by a user.

FIGS. 2 and 3 illustrate one embodiment of the function indicator module 16. The function indicator module 16 can be installed on one side of the projection screen to create the visual status display 22 of the electric fireplace's control settings on the projection screen 14. In an exemplary embodiment, the function indicator module can be installed behind the projection screen as shown in FIG. 8. The function indicator module may be positioned in close proximity to an interior surface 24 of the projection screen 14, or in another embodiment, the function indicator module may be installed in contact with the interior surface 24. In one embodiment, the function indicator module 16 can include touch controls (e.g., buttons or touchscreen controls) that can be used to control the various light and other settings of the function indicator module. The touch controls can be positioned on a front portion 58 of a frame 60 of the electric fireplace 12, as illustrated in FIG. 14A. The touch controls can be manually operated by a user, as shown in FIG. 14B.

Figure 11:
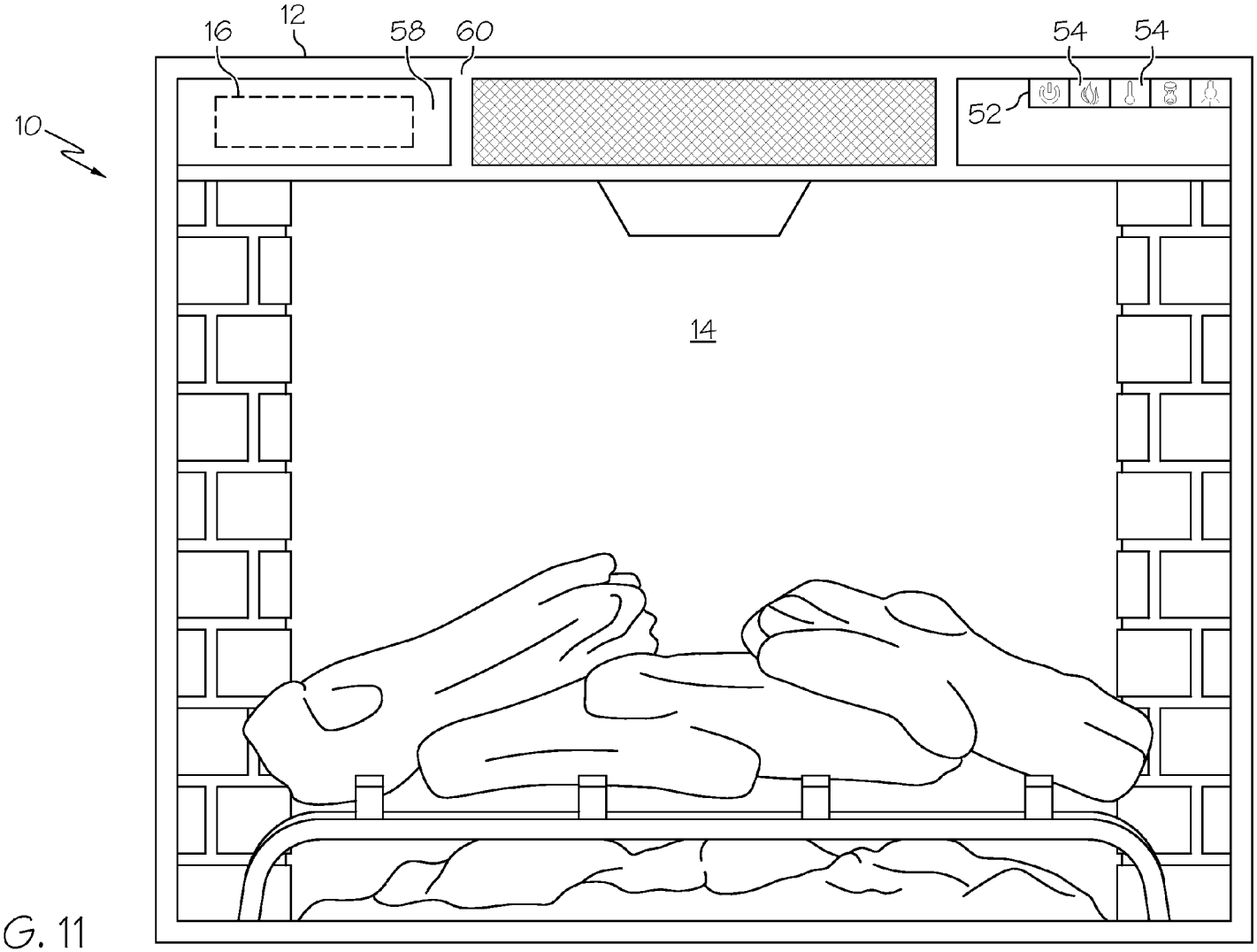
FIG. 11 is a front perspective view of an embodiment of an electric fireplace wherein the function indicator module is installed behind a frame of the electric fireplace.
Figure 12:
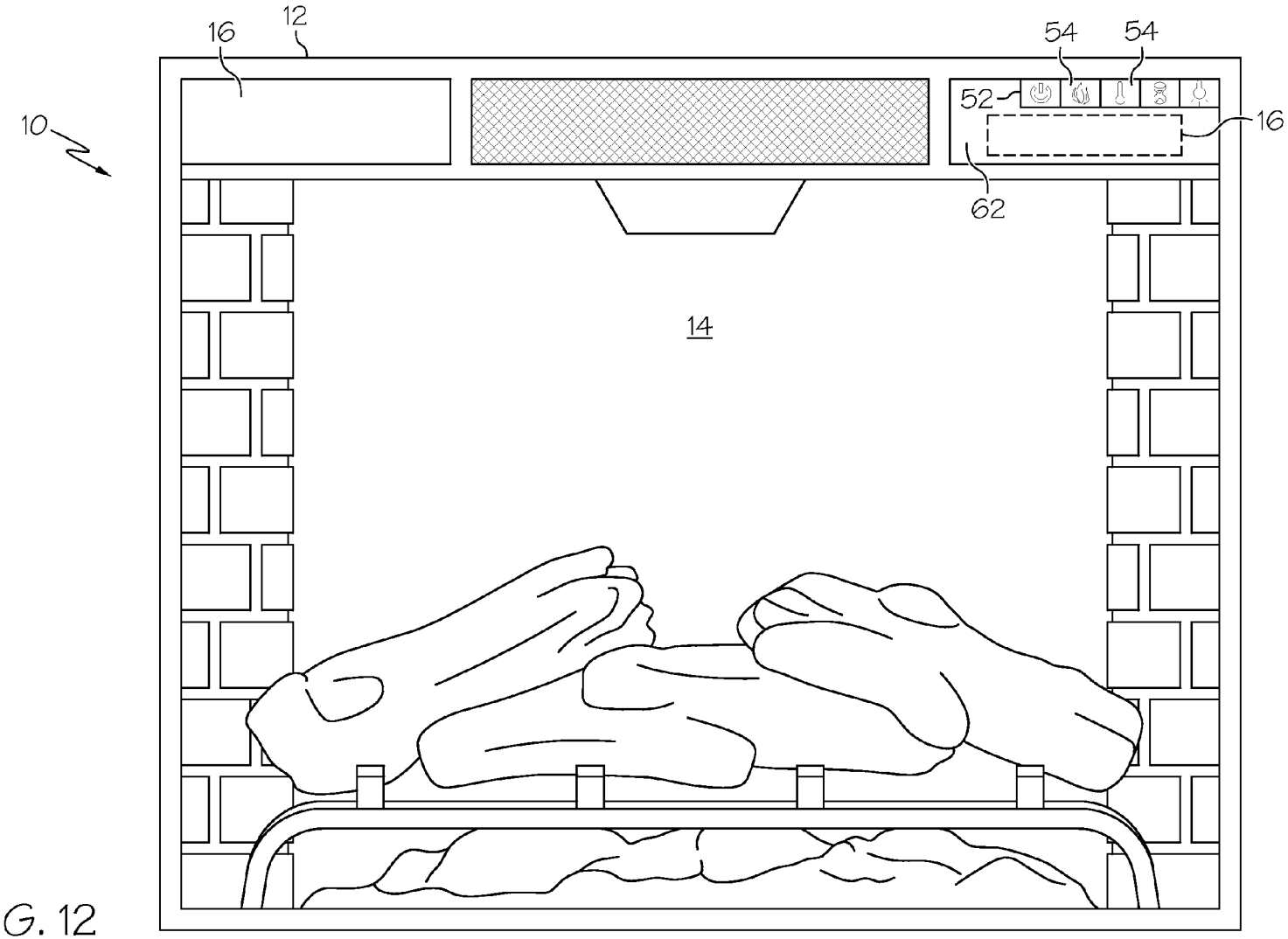
FIG. 12 is a front perspective view of an embodiment of an electric fireplace wherein the function indicator module is installed and concealed within a control panel.
Figure 13:
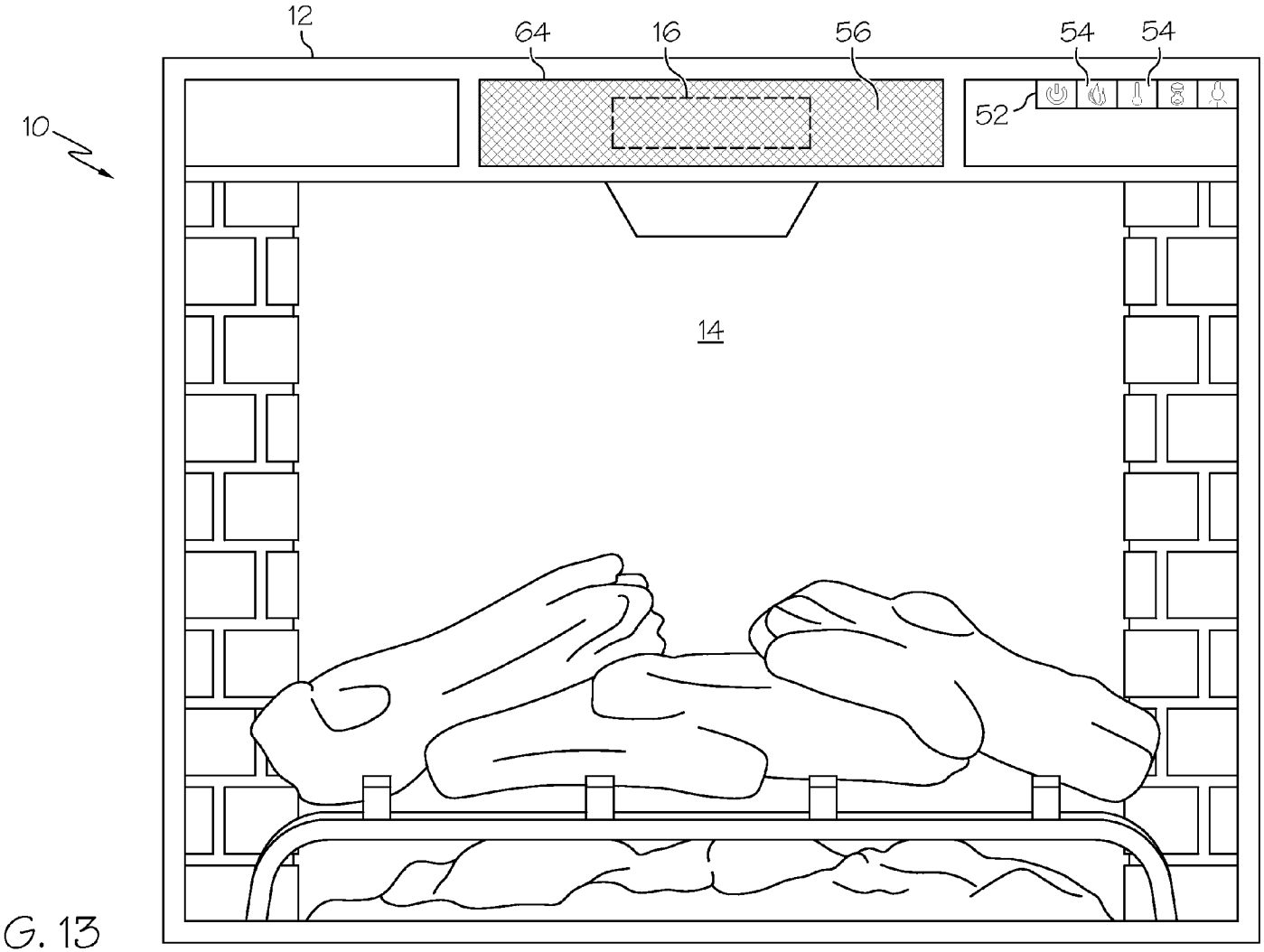
FIG. 13 is a front perspective view of an embodiment of an electric fireplace wherein the function indicator module is installed behind a mesh screen of a heater air outlet grill or mesh screen.

In one embodiment, the function indicator module 16 can be installed and concealed inside of the front portion 58 of the frame 60 of the electric fireplace 12, as shown in FIG. 11. In another embodiment, the function indicator module 16 can be concealed inside a control panel 62, as shown in FIG. 12. The control panel 62 can be installed on the front portion 58 of the electric fireplace's frame 60. The control panel 62 can be a housing within which the controller 18 is partially or entirely contained. In still another embodiment, the function indicator module 16 can be installed and concealed behind a heater air outlet grill or mesh 56, as shown in FIG. 13. The electric fireplace 12 can include a heater such as, for example, an electric heater or a gas heater. The heater air outlet grill or mesh 56 can be installed over an outlet 64 from which heated air is blown by a fan or otherwise passed out of the heater.

The function indicator module 16 can include at least one function indicator light 26. In exemplary embodiments, the function indicator module can include a plurality of function indicator lights 26 each of which can be independently controlled by the controller 18 as a function of selections made by a user with respect to the control settings levels or status of each user-controllable function and feature of the electric fireplace. Each function indicator light can also be connected to the power source 20. The function indicator lights 26 can be any suitable light source including, for example, incandescent or fluorescent lights, but in an exemplary embodiment, light emitting diodes (LEDs) will be used. A single color of LEDs can be used or, in other embodiments, multiple different colors or LEDs may be incorporated in the function indicator module.

Each function indicator light 26 can produce a separate visual status display 22 on the interior surface 24 of the projection screen 14 that is visible to viewers on an exterior surface 28 of the projection screen. Control settings that may be projected onto the projection screen by the function indicator module 16 can include, for example, settings for control status related to system power, heater power, temperature, light brightness or intensity and power, blower or fan speed, timer, simulated flame control, and speaker volume for a burning wood soundtrack that may be used to imitate the sounds associated with actual burning wood.

In an exemplary embodiment, the function indicator module 16 can include a housing 30, at least one function indicator light 26, and a visual display apparatus 32. The housing 30 may be a container featuring an opposing open end 33 and closed end 34 and a plurality (e.g., four) walls. The function indicator light or lights can be installed on an interior surface 36 of the closed end 34 of the housing 30. The visual display apparatus 32 can be installed over and in contact with the open end 33 of the housing 30. In another embodiment, the visual display apparatus 32 can be installed in front of but not in direct contact with the open end of the housing.

Figure 4:
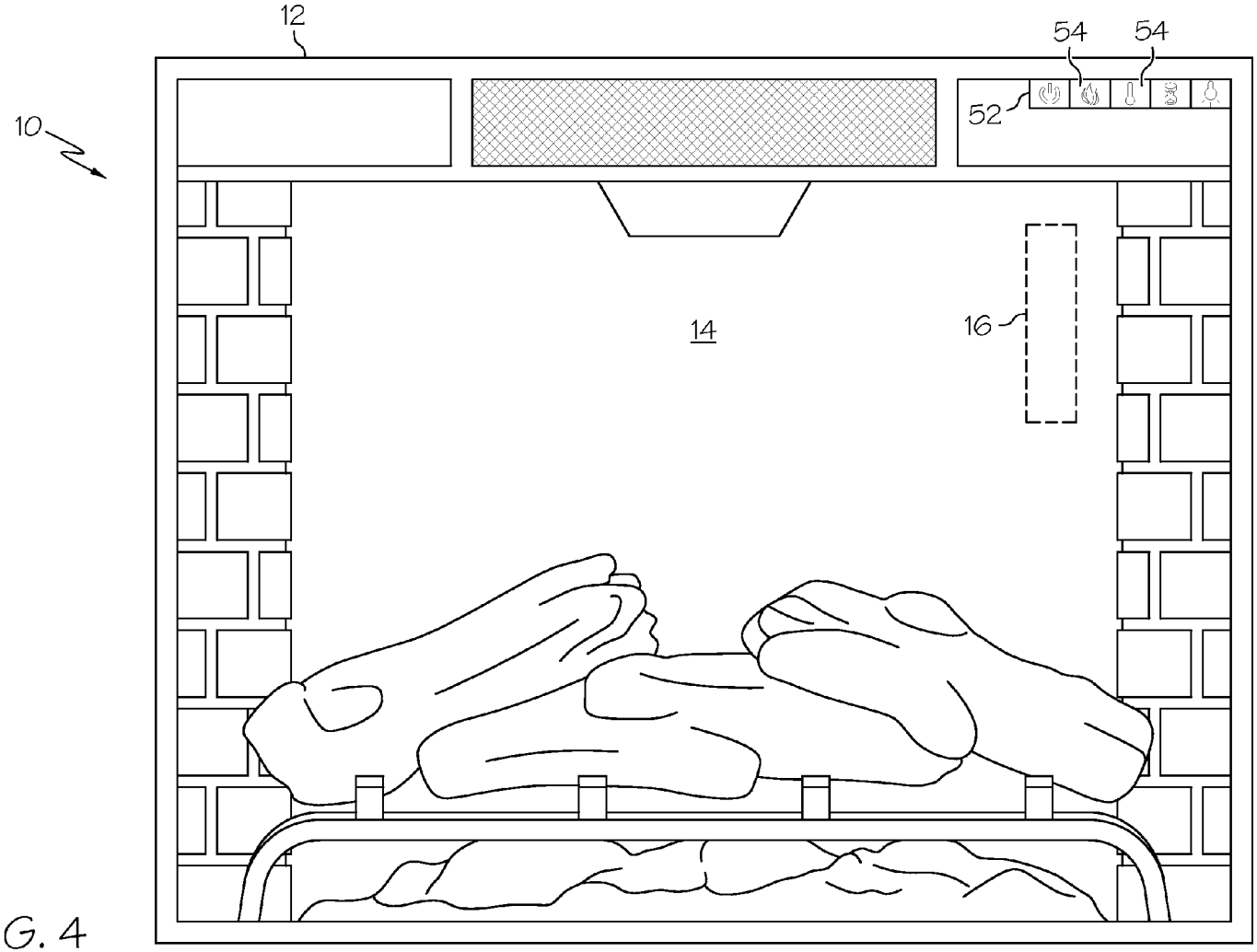
FIG. 4 is a front view of an electric fireplace with the function indicator module shown in phantom behind a projection screen of the electric fireplace.

The function indicator module 16 can be connected to a timer-controlled dimmer 38. After a predetermined period of time during which the visual status display 22 is projected at full brightness or intensity onto the projection screen 14, the dimmer 38 can be programmed to begin decreasing the brightness or intensity of the light emitted by the function indicator lights 26. At a predetermined level of brightness or intensity, the dimmer can then turn off the function indicator lights entirely causing the visual status display 22 to fade and disappear from the projection screen as shown in FIG. 4. The visual status display 22 can fade out smoothly in color gradient, intensity, and brightness after a predetermined time interval as the function indicator lights 26 of the function indicator module 16 sequence through a controlled dimming pursuant to the programmed dimmer's instructions. The predetermined time interval can be 1, 2, 3, 4, 5, 6, 7, 8, 9, 10, or more seconds. By fading smoothly off the projection screen so as not to visible after the predetermined time interval elapses, the function indicator module 16 of the electric fireplace 12 is programmed to cause the visual status display 22 to fade away when not in use so as to maintain the appearance or illusion of the system 10 being a real fireplace, which would not have a visual status display, rather than an electric fireplace.

The visual display apparatus 32 of the function indicator module 16 can feature control status indicia 40. The control status indicia 40 can be semitransparent or opaque so that light must pass around them to form a predetermined pattern or shape on the projection screen 14. The control status indicia 40 can be printed on a translucent film or other semitransparent material. In another embodiment, the control status indicia can be rigid or semi-rigid cut-outs constructed in a shape that permits the function indicator module to project light in a predetermined, desired pattern onto the projection screen. The shapes and patterns formed by light passing through or around the visual display apparatus 32 form the visual status display 22 projected onto the projection screen 14.

Figure 6A:
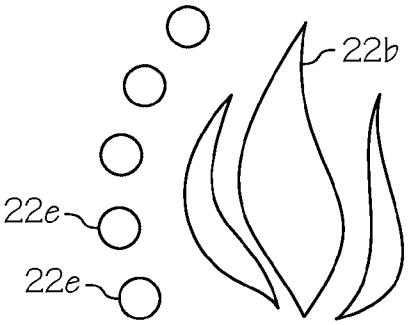
FIG. 6A is a close-up view of a flame intensity control setting status indicator.
Figure 6B:
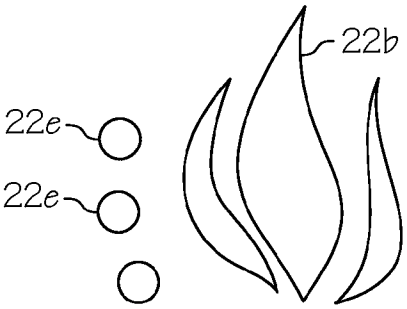
FIG. 6B is a close-up view of another flame intensity control setting status indicator.
Figure 6C:
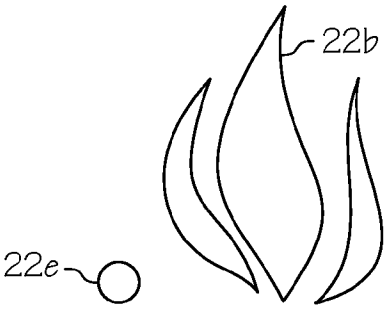
FIG. 6C is a close-up view of still another flame intensity control setting status indicator.
Figure 7A:
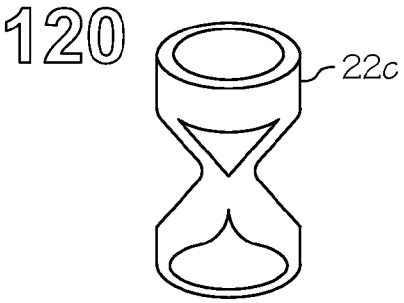
FIG. 7A is a close-up view of a temperature control setting status indicator.
Figure 7B:
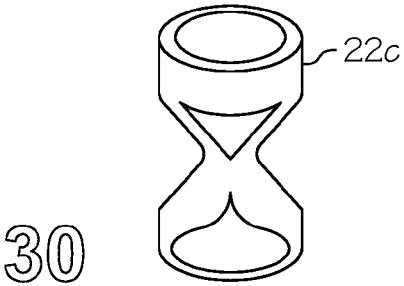
FIG. 7B is a close-up view of another temperature control setting status indicator.

Examples of patterns and shapes of control status indicia that may be used by the invention include patterns and shapes similar to those of the visual status displays shown in FIGS. 6A-7B. The visual status display 22 projected by the function indicator module 16 can include icons or text (for example, alphanumeric characters) that are projected onto one side of the projection screen 14. The icon or text patterns and shapes formed in the visual status display 22 are created by passing light produced by the function indicator lights 26 through similarly shaped control status indicia 40. FIG. 6A-6C show three embodiments of a visual status display for simulated flame intensity control 22*b* with status level indicators 22*e* of high, intermediate, and low intensities, respectively. FIGS. 7A and 7B show two embodiments of a visual status display for timer control 22*c* with status level indicators of 120-minute time period before shutdown and 30-minute time period before shutdown, respectively. At the expiration of a selected time period using the timer control setting, the electric fireplace can automatically power off.

In one embodiment, the visual display apparatus 32 can include a translucent film 42 that can feature printed control status indicia 40. The translucent film 42 can be attached over the open end 33 of the housing 30 so that each of the film's printed control status indicia are aligned with and receive light emitted by an individual function indicator light or group of lights 26 selected by the manufacturer during construction of the function indicator module. The translucent film can be colorless or tinted with color.

Figure 9:
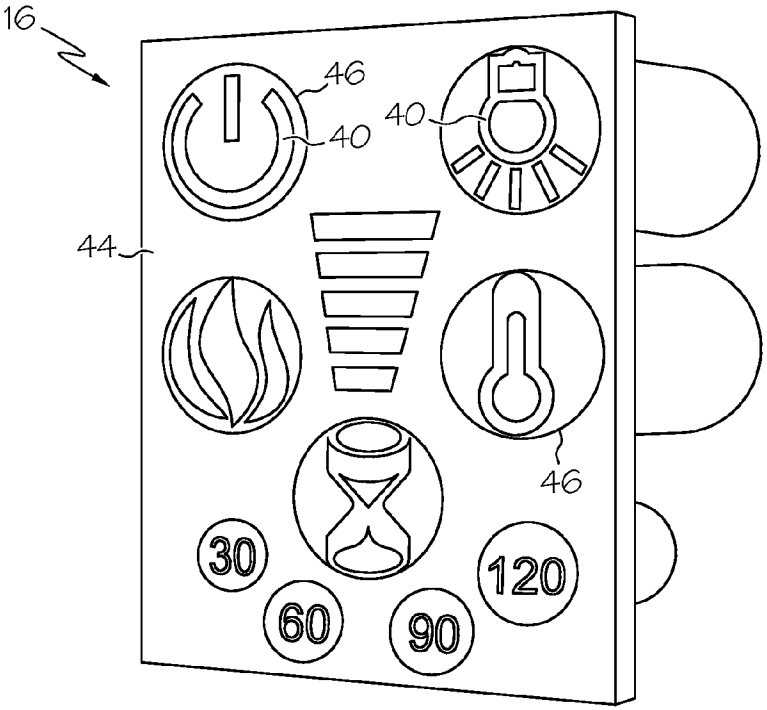
FIG. 9 is a front perspective view of another embodiment of a function indicator module.

In another embodiment, shown in FIG. 9, the visual display apparatus 32 can feature an opaque plate 44 that includes at least one translucent section 46 in alignment with a path of light emitted by a selected function indicator light 26. The opaque plate 44 can be attached over the open end 33 of the housing 30. Each translucent section 46 can include printed control status indicia 40, which can be either semi-transparent or opaque. The translucent sections can be colorless or tinted with color.

Figure 10:
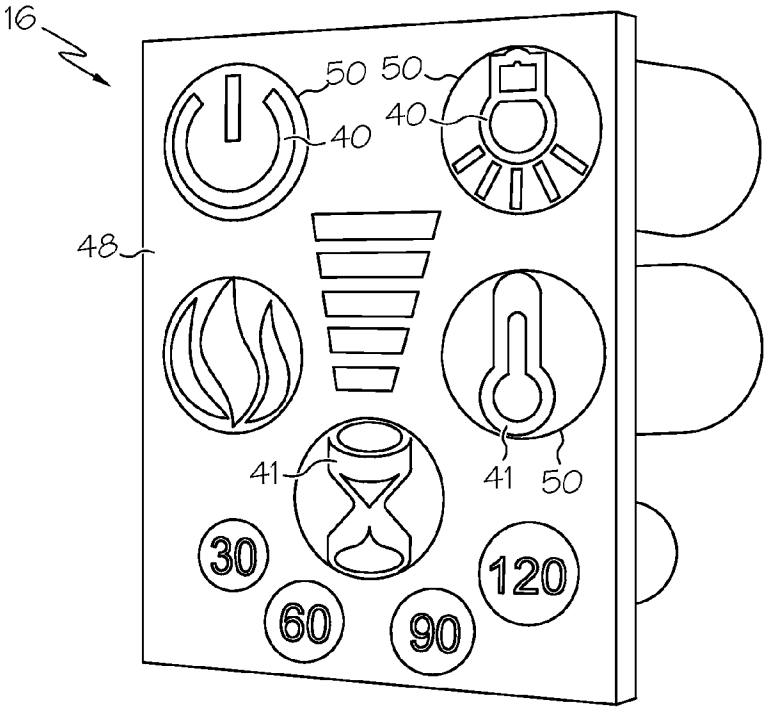
FIG. 10 is a front perspective view of still another embodiment of a function indicator module.

In yet another embodiment, shown in FIG. 10, the visual display apparatus 32 can feature an opaque plate 48 having at least one aperture 50. Each aperture 50 can be aligned with a path of light emitted by at least one function indicator light 26. The opaque plate 48 may include control status indicia 41 positioned within the path of light passing through each aperture 50.

The controller 18 can be communicatively connected to the function indicator module 16, and the power source 20 can be electrically connected to the function indicator module. In one embodiment of the invention, the controller 18 can be a computer. In another embodiment, the controller 18 can be a circuit board that features input and output ports to which the function indicator module is electrically and communicatively connectable. The controller 18 can feature a user control interface 52 that can include at least one set of control features such as, for example, control buttons 54 as shown in FIG. 5, a touchscreen comprising electronically displayed control keys, or a wireless remote control. The controller 18 and the user control interface 52 and its control buttons 54 can be installed within the control panel 62. The controller 18 can feature a heater power control feature that separately controls the heater so that the heater can be turned on and off by the user to enable or disable its heating element or elements. The heater power control feature can be a touchscreen control or an actual button that can be pressed and held for a predetermined period of time to control power to the heater. In another embodiment, the heater power control feature can be a switch that can depressed, flipped, or otherwise moved between power on and power off settings.

Power to the heater may be enabled and disabled manually using the heater disabling control feature. The heater disabling feature can be a dual-use concealed feature of any of the control features of the electric fireplace, but in exemplary embodiments, will not be the same control feature as the heater power control feature. In some embodiments, the controller 18 may also be programmed by the user using user-created settings or factory settings to turn power to the heater on or off after a selected period of time. When the heater disabling feature is turned on or off, the visual display apparatus 32 can include control status indicia 40 useful for projecting an icon, text (e.g., alphanumeric characters), or other suitable visual cue onto the projection screen 14 of the electric fireplace 12 to indicate that the heater has been turned off or disabled. For example, the control status indicia could be shaped to project a flame icon onto the projection screen when the heater power is enabled, and the function indicator light creating the flame icon may be turned off when the heater power is disabled. In another example, a simulated flame light system of the electric fireplace can be programmed through the controller to flash or pulse its simulated flame effects in a logset of the electric fireplace. In yet another example, a simulated ember bed light system can be programmed through the controller to flash or pulse its simulated ember bed light effects in an ember bed of the electric fireplace. In some embodiments, both the simulated flame light system and simulated ember bed light system may be programmed to flash or pulse their light effects simultaneously or in various alternating sequences to signal that power to the heater has been turned on or off. In any of these embodiments and examples, the light effects may be flashed or pulsed one, two, three or more times to signify visually to a user that the heater's power has been enabled or disabled. In still another embodiment, the electric fireplace can emit or produce a sound (e.g., a tone) from a speaker or other sound generating device that indicates audibly to the user that the heater has been powered on or off. The tones or light flashes or pulses may differ depending on whether the power to the heater is being enabled or disabled.

The power source 20 can be any suitable power source such as, for example, connection to an electrical grid via an electrical outlet, a battery, or an alternative power supply, e.g., connection to a solar panel or wind turbine. The electric fireplace, function indicator module, and controller may be connected to the same power source or to different power sources.

The invention also features methods for visually displaying the control settings of an electric fireplace. The method can include the step of projecting light emitted by a light source through a function indicator module. The function indicator module can feature control status indicia. In the next step, light passing through the control function indicator module can be projected onto a projection screen of an electric fireplace to create a visual display of the electric fireplace's control settings on an exterior surface the projection screen. In another step, a user can vary the characteristics of the visual display by changing the user's control input selections related to control of the electric fireplace's control settings.

In another embodiment, the method can also include the step of projecting the visual display onto the projection screen for a predetermined period of time. The method can further include a step in which the light source creating the visual display can be dimmed after a predetermined period of time. The light source can be dimmed until the light source is turned off and the visual display disappears from the exterior surface of the projection screen.

In one embodiment, the method can include the step of projecting an icon, text (e.g., alphanumeric characters), or other suitable visual cue onto the projection screen of the electric fireplace to indicate that a heater of the electric fireplace has been turned off or disabled. The heater of the electric fireplace can be disabled electronically by manually pressing a button or touchscreen control. In another embodiment, the method may require that the button or touchscreen control be pressed and held for a predetermined amount of time before power to the heater is turned on or off. In addition, or alternatively, to the step of projecting the visual cue to indicate that the heater is disabled, the method can further include either or both of the step of flashing a light effect in a logset or ember bed of the electric fireplace and the step of emitting a sound (e.g., a tone) from a speaker or other sound generating device.

The invention also features a method of disabling a heater of the electric fireplace. The electric fireplace can include a heater disabling feature and a heater power control feature. The heater power control feature can be a button or touchscreen control that can be pressed to turn on and off power to the heater, thereby turning off the heater until the next time the heater is turned on by pressing the same or a different button or touchscreen control. The heater disabling feature also can be a button or touchscreen control that can be pressed to disable the heater by turning off power to the heater, thereby disabling the electric fireplace from heating until the next time the heater is enabled on by pressing the same or a different button or touchscreen control. In exemplary embodiments, rather than being a separate marked control dedicated to disabling the heater, the heater disabling feature can be a concealed feature of another control feature of the electric fireplace. For example, the system power button, as opposed to the heater power control feature, might also serve as the heater disabling feature so that if a user presses and holds the system power button for, for example, ten seconds, the heater is disabled but the system's other features (e.g., simulated flame and ember bed light systems) remain powered on and operational. When the heater is disabled using the heater disabling feature, the heater cannot be turned on using the heater power control feature, which is normally used to control the power on and power off selections for the heater.

The heater disabling feature can be a concealed control feature that can be utilized in retail stores to prevent customers from turning on the power to display models of the electric fireplace while still operating lighting systems and other control features of the electric fireplace. The heater disabling feature can be also be used as a concealed security feature by parents or guardians to prevent children from turning on the heater.

In an exemplary embodiment, the heater disabling feature and the heater power control feature are different and separate control buttons, touchscreen controls, or other control features of the electric fireplace. In other embodiments, the heater disabling feature and the heater power control feature can be the same control button, touchscreen control, or other control feature of the electric fireplace, so that the operation of each feature of the two controls is selected by pressing the control feature for two different intervals of time.

In another step of the method, the method may require that the button or touchscreen control be pressed and held for a predetermined period of time to turn power to the heater on or off. For example, the button or touchscreen control could be pressed by the user and held for a period of one, two, three, five, or ten seconds to turn the power on or oft as the case may be, to the heater. The method can further include the step of projecting an icon, text (e.g., alphanumeric characters), or other suitable visual cue onto the projection screen of the electric fireplace to indicate that the heater of the electric fireplace has been turned off and disabled so as not to produce heat until turned on again. In another step of the method, an audible tone or other sound may be played a speaker or other sound generating device of the electric fireplace when power to the heater is turned on or off. The audible tone or other sound may be played in addition to or exclusive of the visual cue. In exemplary embodiments, when the heater is disabled by powering off, the electric fireplace can display an indicator, flash the lighting of the ember bed, flash the lighting of the simulated flames, and play an audible sound, e.g., a tone or voice recording indicating that power to heater has been disabled. Combinations of one or more of these indicators may be used to alert the user when power to the heater has been disabled. Similar or identical visual and auditory indicators and combinations thereof may also be used to alert the user when the power to the heater has been enabled.

Other Embodiments

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A system for displaying the control settings for an electric fireplace, the system comprising:

an electric fireplace comprising a simulated fuel source and a projection screen;

a function indicator module for creating a non-video visual status display of the electric fireplace's control settings on the projection screen, wherein the non-video visual status display comprises projected light;

a controller communicatively connected to the function indicator module;

a heater power control feature to turn on and off power to the heater;

a heater disabling feature operable to selectively create the simulated flame effect without operating the heater, the heater disabling feature being separate and distinct from the heater power control feature;

a power source; and a light source to create a simulated flame effect on the projection screen;

wherein the simulated fuel source is constructed from natural or artificial materials.

2. The system of claim 1, wherein the function indicator module comprises at least one function indicator light relating to operation of the electric fireplace.

3. The system of claim 2, wherein a visual status display created by the function indicator module is visible on an exterior surface of the projection screen as a projected icon or text.

4. The system of claim 2, wherein the projected icon or text comprises the visual status display for at least one of the following settings: system power, heater power, temperature, light brightness, blower or fan speed, timer, flame control, and speaker volume.

5. The system of claim 1, wherein the electric fireplace further comprises a heater, wherein the heater comprises a heater air outlet covered by a grill or mesh.

6. The system of claim 5, wherein the function indicator module is installed inside the electric fireplace behind the grill or mesh of the heater air outlet.

7. The system of claim 5, wherein the system comprises a heater power control feature to turn on and off the power to the heater, wherein the heater power control feature comprises a button or touchscreen control that is depressible for a predetermined period of time to power the heater on and off, and wherein the system comprises a temperature control feature.

8. The system of claim 5, comprises a heater power control feature to turn on and off the power to the heater and a separate heater disabling feature capable of being operated to enable or disable the heater while keeping other system features powered on and operational; wherein the heater disabling feature is a concealed feature of a control feature of the electric fireplace other than the heater power control feature; wherein the concealed feature is engaged by holding a button for a duration; wherein the heater disabling feature is discrete from and operated independently from the heater power control feature.

9. The system of claim 5, wherein the system further comprises at least one first device for generating a first signal that is perceivable visually or audibly by a user, wherein the first signal indicates to the user that power to the heater has been turned on so that heat will be generated, and at least one second device for generating a second signal that is perceivable visually or audibly by a user, wherein the second signal indicates to the user that power to the heater has been turned off so that heat will not be generated.

10. The system of claim 9, wherein the first signal comprises an audible tone or sound, a visible flash or pulse of light, an icon or text comprised of light visibly projected onto a projection screen of the electric fireplace, or a combination of one or more of these signals, and wherein the second signal comprises an audible tone or sound, a visible flash or pulse of light, an icon or text comprised of light visibly projected onto a projection screen of the electric fireplace, or a combination of one or more of these signals.

11. The system of claim 1, wherein the system further comprises a dimmer that is communicatively connected to the function indicator module.

12. The system of claim 11, wherein the dimmer is programmed to vary the brightness and intensity of light emitted by the at least one function indicator light.

13. The system of claim 12, wherein the at least one function indicator light sequences through a range of light intensity from no light to the brightest light setting so that the light of a visual status display, which visual status display comprises light emitted by the at least one function indicator light of the function indicator module that is projected so as to be visible on an exterior surface of the projection screen, fades away partially or entirely after a predetermined period of time.

14. The system of claim 11, wherein the at least one function indicator light of the function indicator module projects a visual status display comprised of light onto the projection screen so as to be visible from outside the fireplace, wherein the function indicator module is programmed to fade away the visual status display so as not to be visible when control features of the electric fireplace are not in use.

15. The system of claim 1, wherein the electric fireplace comprises a frame comprising a front portion.

16. The system of claim 15, wherein the function indicator system is installed inside the electric fireplace behind an interior surface of the front portion of the frame.

17. The system of claim 1, wherein the electric fireplace further comprises a control panel installed on a front portion of a frame of the electric fireplace, wherein the control panel comprises a housing.

18. The system of claim 17, wherein the function indicator module is installed inside the control panel.

19. The system of claim 1, wherein the function indicator module comprises touchscreen controls.

20. A method for indicating enablement or disablement of a power setting of a heater of an electric fireplace, the method comprising the steps of:

(a) providing an electric fireplace that comprises a heater, a heater power control feature, and a heater disabling feature, wherein the heater disabling feature is separate and distinct from the heater power control feature, and wherein the electric fireplace comprising a simulated fuel source constructed using natural or artificial materials and further comprising a simulated flame light system, a simulated ember bed light system, or both;

(b) as desired, using the heater power control feature to turn on and turn off power to the heater and using the heater disabling feature to disable the heater so that the heater cannot be turned on using the heater power control feature while allowing the simulated flame light system, simulated ember bed light system, and other non-heater features of the electric fireplace to continue to operate;

(c) providing a first signal that is perceivable visually or audibly or both audibly and visually by a user, wherein the first signal indicates to the user that the heater has been enabled using the heater disabling feature so that heat will be generated; and (d) providing a second signal that is perceivable visually or audibly or both audibly and visually by a user, wherein the second signal indicates to the user that the heater has been disabled using the heater disabling feature so that heat will not be generated;

wherein a light source is operable to create a simulated flame effect on the projection screen;

wherein if the first signal comprises a visual signal, the visual signal comprises light effects produced by a simulated flame light system, a simulated ember bed light system, or both; and wherein if the second signal comprises a visual signal, the visual signal comprises light effects produced by a simulated flame light system, a simulated ember bed light system, or both.

21. The method of claim 20, wherein the first signal comprises an audible tone or sound, a visible flash or pulse of light, an icon or text comprised of light visibly projected onto a projection screen of the electric fireplace, or a combination of one or more of these signals, and wherein the second signal comprises an audible tone or sound, a visible flash or pulse of light, an icon or text comprised of light visibly projected onto a projection screen of the electric fireplace, or a combination of one or more of these signals.

22. A method for disabling a heater of an electric fireplace, the method comprising the steps of:

(a) providing an electric fireplace comprising a heater, a heater power control feature, and a heater disabling feature, the electric fireplace comprising a simulated fuel source constructed using natural or artificial materials;

(b) using the heater disabling feature, disabling the heater so that power to the heater cannot be turned on using the heater power control feature of the electric fireplace; and (c) providing a signal that is perceivable visually or audibly or both audibly and visually by a user, wherein the signal indicates to the user that power to the heater has been disabled so that the heater cannot be powered on;

wherein a light source is operable to create a simulated flame effect on the projection screen;

wherein the heater disabling feature is discrete from and operated independently from the heater power control.

23. The method of claim 22, wherein step (b) of the method further comprises manually pressing the heater power control feature.

24. The method of claim 22, wherein step (b) of the method further comprises turning off power to the heater after a predetermined period of time in response to instructions received from a controller communicatively connected to the heater disabling feature.

25. The method of claim 23, wherein the heater disabling feature is operated using a different control feature of the electric fireplace so as to be a concealed feature of the different control feature.

26. The method of claim 22, wherein the signal comprises an audible tone or sound, a visible flash or pulse of light, a flash of light in an ember bed of the electric fireplace, a flash of light of simulated flames of the electric fireplace, an icon or text comprised of light visibly projected onto a projection screen of the electric fireplace, an icon or text comprised of light visible on a control panel or frame of the electric fireplace, or a combination of one or more of these signals.

27. A system for disabling a heater of an electric fireplace, the system comprising:

an electric fireplace comprising a simulated fuel source, a heater, and a projection screen;

a function indicator module for creating a non-video visual status display of the control settings of the electric fireplace on the projection screen, wherein the non-video visual status display comprises projected light;

a controller communicatively connected to the function indicator module;

a power source;

a light source to create a simulated flame effect on the projection screen;

a heater power control feature to turn on and off power to the heater; and a heater disabling feature operable to selectively create the simulated flame effect without operating the heater, the heater disabling feature being a concealed feature of a control feature of the electric fireplace separate and distinct from the heater power control feature;

wherein the simulated fuel source is constructed from natural or artificial materials;

wherein the heater disabling feature is separate from the heater power control feature;

wherein the heater disabling feature is engaged and operated separately and independently from the heater power control feature.

28. The system of claim 27, wherein an icon is projected to the projection screen indicative of the heater being enabled or disabled.

29. The system of claim 27, wherein the concealed feature is engaged by holding a button for a duration.

* * * * *